US007744297B2

(12) United States Patent
Nakajima

(10) Patent No.: US 7,744,297 B2
(45) Date of Patent: Jun. 29, 2010

(54) STICKY NOTE PRINTER AND METHOD OF CONTROLLING THE SAME

(75) Inventor: Kenichi Nakajima, Shimosuwa-machi (JP)

(73) Assignee: Seiko Epson Corporation, Tokyo (JP)

( * ) Notice: Subject to any disclaimer, the term of this patent is extended or adjusted under 35 U.S.C. 154(b) by 780 days.

(21) Appl. No.: 11/621,963

(22) Filed: Jan. 10, 2007

(65) Prior Publication Data

US 2007/0183831 A1 Aug. 9, 2007

(30) Foreign Application Priority Data

Feb. 6, 2006 (JP) ..... 2006-028603

(51) Int. Cl.
*B42D 5/00* (2006.01)
*B41J 29/38* (2006.01)

(52) U.S. Cl. ..... 400/76; 400/624; 400/629; 221/42; 221/210

(58) Field of Classification Search ..... 400/624, 400/76, 625; 221/42, 43, 210; *B42D 5/00*
See application file for complete search history.

(56) References Cited

U.S. PATENT DOCUMENTS 6,971,806 B2 * 12/2005 Wessells et al. ..... 400/48

FOREIGN PATENT DOCUMENTS

JP 2002-052760 2/2002
JP 2003-011437 1/2003

* cited by examiner

*Primary Examiner*—Judy Nguyen
*Assistant Examiner*—Jennifer Simmons
(74) *Attorney, Agent, or Firm*—Hogan Lovells US LLP

(57) ABSTRACT

In a sticky note printer, a sticky note is peeled off and fed one by one from a bundle of notes set in position. In empty-feed motion, the sticky note is fed in a normal direction from a peel-off position through a sticky note ejecting slot to a pull-out position in which the sticky note protrudes outside the sticky note printer. In feed-back motion, the sticky note is fed in a reverse direction from the pull-out position to a retracted position in which printing can be performed. In feed-again motion, the sticky note is fed in the normal direction from the retracted position to the pull-out position. The empty-feed motion is made when the sticky note has been pulled away from the pull-out position. The feed-back motion or the feed-again motion is made, when an instruction for printing is given, in a manner synchronized with the printing operation.

8 Claims, 4 Drawing Sheets

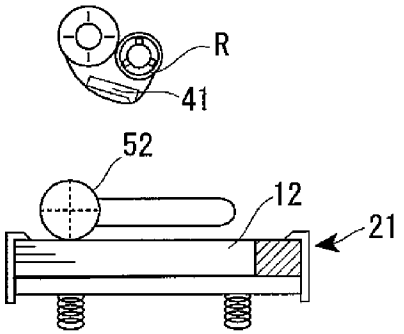
Fig. 4A
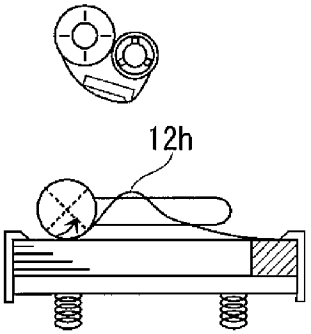
Fig. 4B
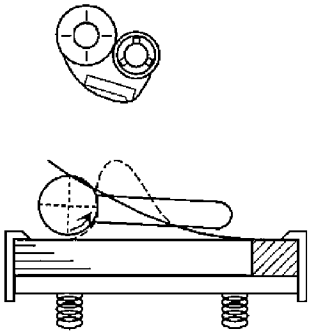
Fig. 4C
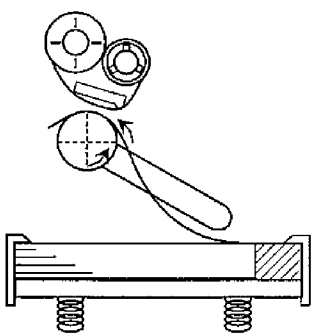
Fig. 4D
Fig. 4E
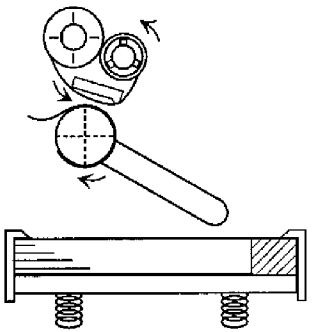
Fig. 4F
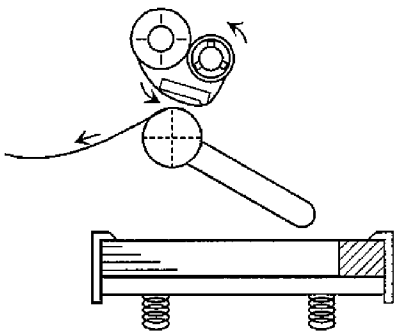
Fig. 4G
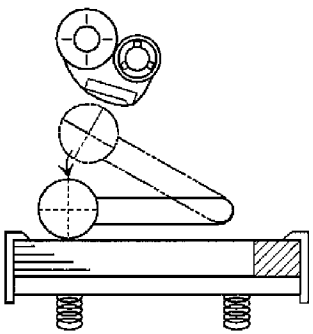
Fig. 4H

STICKY NOTE PRINTER AND METHOD OF CONTROLLING THE SAME

The entire disclosure of Japanese Patent Application No. 2006-028603, filed Feb. 6, 2006, is expressly incorporated by reference herein.

BACKGROUND

1. Technical Field

The present invention relates to a sticky note printer for printing on a sticky note to be peeled off one by one from a bundle of sticky notes. It also relates to a method of controlling the sticky note printer.

2. Related Art

Conventionally, as this kind of sticky note printer, there is known the following one. Namely, a sticky note is peeled off one by one from the upper surface of a bundle of sticky notes contained inside the sticky note printer. Printing is performed on a printing surface of the sticky note while feeding it, and the printed sticky note is ejected out of an ejecting slot provided ahead as seen in the feeding direction thereof. In this kind of sticky note printer, when a user wishes to use the sticky note for manual writing thereon instead of printing with the sticky note printer, print execution key is depressed without data input so that the sticky note can be ejected without printing thereon. JP-A-2003-11437 is an example of related art.

However, in this sticky note printer, the user must operate the key also in case he or she wishes to use the sticky note in a print-free state (i.e., a state in which printing is not made on the sticky note), in the same manner as in the case of using it by performing printing thereon. Particularly, in case a plurality of print-free sticky notes are needed, the key operation must be made for the same number of times as the number of sheets of the sticky notes. This kind of repeated operation of the key is troublesome because the sticky notes cannot be made readily available for use when it is needed.

SUMMARY

Therefore, it is an advantage of the invention to provide a sticky note printer which can hold a sticky note ready for printing while it is also ready for being pulled out of position, and also to provide a method of controlling the same.

According to one aspect of the invention, there is provided a sticky note printer comprising a printing device for printing on a sticky note which is peeled off and fed one by one from a bundle of sticky notes set in position, and a feeding device for performing: an empty-feed motion in which the sticky note is fed in a normal direction from a peel-off position through a sticky note ejecting slot to a pull-out position in which the sticky note protrudes outside the sticky note printer; a feed-back motion in which the sticky note is fed in a reverse direction from the pull-out position to a retracted position in which printing can be performed by the printing device; and a feed-again motion in which the sticky note is fed in the normal direction from the retracted position to the pull-out position. The sticky note printer also comprises an instructing device for giving an instruction for printing on the sticky note, a detecting device for detecting presence or absence of the sticky note in the pull-out position, and a control device for controlling the printing device and the feeding device. The control device performs in a state in which the sticky note is fed to the pull-out position: the empty-feed motion upon detection of absence of the sticky note by the detecting device on condition of no instruction from the printing device; the feed-back motion and the feed-again motion upon receipt of an instruction from the printing device on condition of detection of presence of the sticky note by the detecting device; and a printing motion by driving the printing device in a manner synchronized with one of the feed-back motion and the feed-again motion.

According to another aspect of the invention, there is provided a method of controlling a sticky note printer. The sticky note printer comprises a printing device for printing on a sticky note which is peeled off and fed one by one from a bundle of sticky notes set in position, and a feeding device for performing: an empty-feed motion in which the sticky note is fed in a normal direction from a peel-off position through a sticky note ejecting slot to a pull-out position in which the sticky note protrudes outside the sticky note printer; a feed-back motion in which the sticky note is fed in a reverse direction from the pull-out position to a retracted position in which printing can be performed by the printing device; and a feed-again motion in which the sticky note is fed in the normal direction from the retracted position to the pull-out position. The method comprises: performing the empty-feed motion when the sticky note is pulled out of position from a state in which the sticky note is fed to the pull-out position; performing the feed-back motion and feed-again motion when an instruction for printing is given; and performing a printing motion by driving the printing device in a manner synchronized with one of the feed-back motion and the feed-again motion.

In this case, it is preferable that the state in which the sticky note has been fed to the pull-out position be an ordinary state at least under a condition in which the sticky note printer is powered on.

According to this configuration, once the user has pulled out the sticky note away from the ejecting slot, the detecting device detects the pulling out of the sticky note, and a print-free sticky note inside the sticky note printer is fed in a manner to protrude outside the sticky note ejecting slot. Therefore, the user can successively obtain print-free sticky notes one after another without the necessity of operating predetermined keys. On the other hand, if the user wishes to print on the sticky note, he or she may issue an instruction for printing. Then, the sticky note in the above-described state is pulled back into the sticky note printer, is subjected to printing, and is fed once again for protruding out of the sticky note ejecting slot. The printed sticky note can thus be pulled out for putting it to actual use. In this manner, the sticky note can be kept ready for printing while it can be pulled out any time. By making this state as an ordinary state, the ease with which the user can use the sticky note printer is improved.

In this case, it is preferable that the feeding device feed the sticky note with a free end thereof at a head of moving direction in the empty-feed motion and the feed-again motion.

According to this configuration, since the sticky note is ejected with the free end thereof leading the moving direction, jamming around the sticky note ejecting slot can be prevented, thereby making it easier for the user to pull out the sticky note.

In this case, it is preferable that the feeding device comprise a roller for feeding the sticky note in the normal direction and in the reverse direction by coming into rotating contact with that side of the sticky note which has a glued portion, and that a circumferential length of the roller be greater than the length of the sticky note as seen in the feeding direction thereof.

According to this configuration, it is possible to rectify the bending tendency of the sticky note rolled round the roller by means of the glued portion. Further, since the sticky note does not form an overlapped portion, there can be prevented jamming due to slippage at the overlapped portion of the sticky note.

In this case, it is preferable that the roller be disposed near the sticky note ejecting slot, and that, in the pull-out position, the glued portion of the sticky note be in contact with the roller.

According to this configuration, since the sticky note is exposed to the outside of the sticky note printer for the most part thereof except for the base portion thereof, the user can easily pick it for pulling it out of the sticky note printer. In addition, since there can be attained a state in which the glued portion is slightly glued to the roller, the sticky note can be prevented from dropping out of position due to vibrations and the like.

In this case, it is preferable that the printing device comprise a thermal head, and that the roller serve a dual purpose of a platen which lies opposite to the thermal head.

According to this configuration, there is no need of additionally providing the sticky note printer with a platen roller. Therefore, the number of constituting parts and the consequent number of assembling man-hours can be reduced. In addition, the sticky note printer can be constituted in a compact manner.

In this case, it is preferable that the printing device comprise a ribbon feeding mechanism for feeding an ink ribbon along with the sticky note in a manner synchronized with driving of the printing device only at the time of driving the printing device.

According to this configuration, the ink ribbon can be prevented from being wasted and, since the ink ribbon is not paid out except at the time of driving the printing device, the useless slackening of the ink ribbon can be prevented.

BRIEF DESCRIPTION OF THE DRAWINGS

The invention will be described with reference to the accompanying drawings, wherein like numbers reference like elements.

FIGS. 4A to 4H are schematic side views showing a series of operations of the sticky note printer.

DESCRIPTION OF EXEMPLARY EMBODIMENTS

A description will now be made about a sticky note printer and a method of controlling the same according to one embodiment of the invention. The sticky note printer is connected to a personal computer to print on a sticky note various data such as characters and figures prepared and selected by the personal computer.

Figure 1:
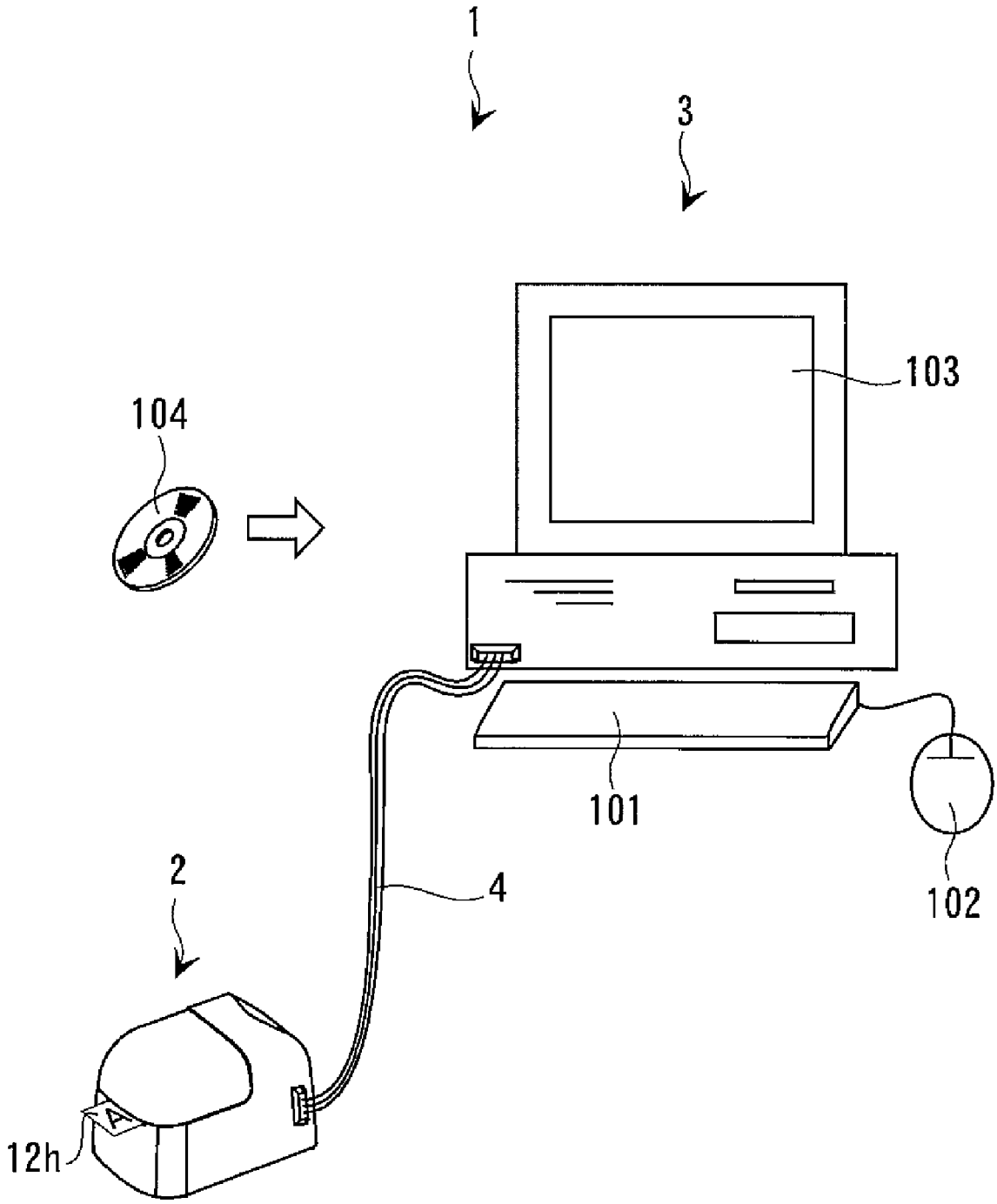
FIG. 1 is a schematic arrangement showing the sticky note printing system.

FIG. 1 is a schematic diagram showing an arrangement of a sticky note printing system 1 which is made up of: a sticky note printer 2; a personal computer 3 which is disposed outside the printer 2 and supplies the sticky note printer 2 with printing data; and a cable 4 for connecting (linking) the above together. The connection may alternatively be made by means of wireless connection instead of by the cable 4.

The personal computer 3 has connected thereto a keyboard 101 and a mouse 102 for data inputting, and is so arranged that the result of inputting from the keyboard 101 and the mouse 102 is displayed on a display 103. An application software (program) for preparing the printing data for the sticky note printer 2 is arranged to be started up from an external storage medium such as a CD-ROM 104.

When various detection signals, various instructions, various data and the like are inputted, a control unit 105 (see FIG. 3) constituted by a CPU, memory and the like processes the data inside the memory and controls the sticky note printer 2 according to the application software. It may be so arranged that the sticky note printer 2 is provided with a preparation function, an editing function, and a control function for print data so that the sticky note printer 2 can print on a sticky note 12*h* as an independent apparatus. An instructing device used in claims is materialized by inputting to the control unit 105 various detection signals, various instructions, various data and the like from the keyboard 101 and the mouse 102.

Figure 2:
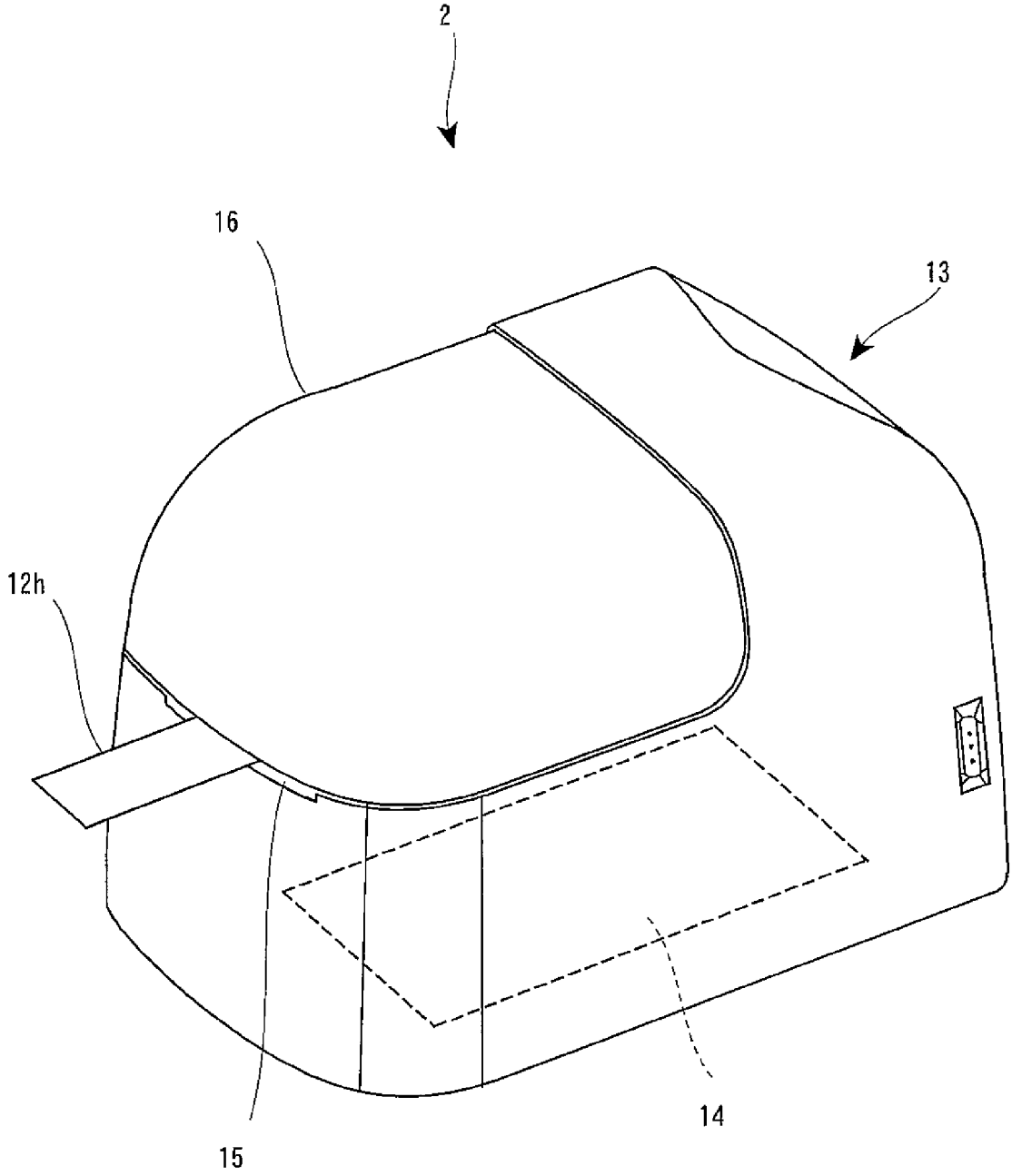
FIG. 2 is an overall perspective view of a sticky note printer according to one embodiment of this invention.

As shown in FIG. 2, the sticky note printer 2 is constituted by covering with a printer casing 13 an internal apparatus which is assembled in advance. It is so arranged that a bundle of sticky notes 12 can be set in position from the bottom side of the printer casing 13 (see FIG. 3). It may alternatively be so arranged that the bundle of sticky notes can be mounted on a cassette so that the cassette can be mounted in a manner drawable from the front side of the sticky note printer 2. In this sticky note printer 2 having the above-described arrangement, the bundle of sticky notes 12 set in position are peeled off one by one from the uppermost one 12*h* and, in a state in which printing is not performed, are held in a standby state by causing the uppermost sticky note 12*h* to protrude out of (or to partly project beyond) a sticky note ejecting slot 15 formed in the printer casing 13. Based on print data and an instruction for printing outputted from the personal computer 3, the sticky note is fed for printing toward the inside of the sticky note printer. After printing, the printed sticky note is fed again toward the sticky note ejecting slot 15.

The bundle of sticky notes 12 is made by partly gluing the back surface (i.e., surface which is opposite to that to be printed) of base end portions (as seen in the longitudinal direction thereof) of a large number of sticky notes 12*h* of the same shape, and laminating them together. The sticky notes 12*h* are arranged to be capable of being peeled off one by one out of the bundle of sticky notes 12 and to be capable of being adhered again (i.e., repositionable), after once being peeled off, to an object of adhesion (i.e., an object to which the sticky note is adhered) by means of the glued portion.

The printer casing 13 has formed at the bottom surface thereof a sticky note feed opening 14 for setting in position the bundle of sticky notes 12 into the printer casing 13 from the bottom side. In the front center of the printer casing 13, there is formed the sticky note ejecting slot 15 in the form of a horizontal slit which serves the purpose of ejecting the printed sticky note 12*h* toward the outside the printer casing 13 or of protruding the print-free (i.e., not printed yet) sticky note 12*h* outside the printer casing 13. Further, on the front upper surface of the printer casing 13, there is formed an open-close lid 16 for mounting a ribbon cartridge C into, and detaching it out of, an inner mechanism of the sticky note printer 2.

Figure 3:
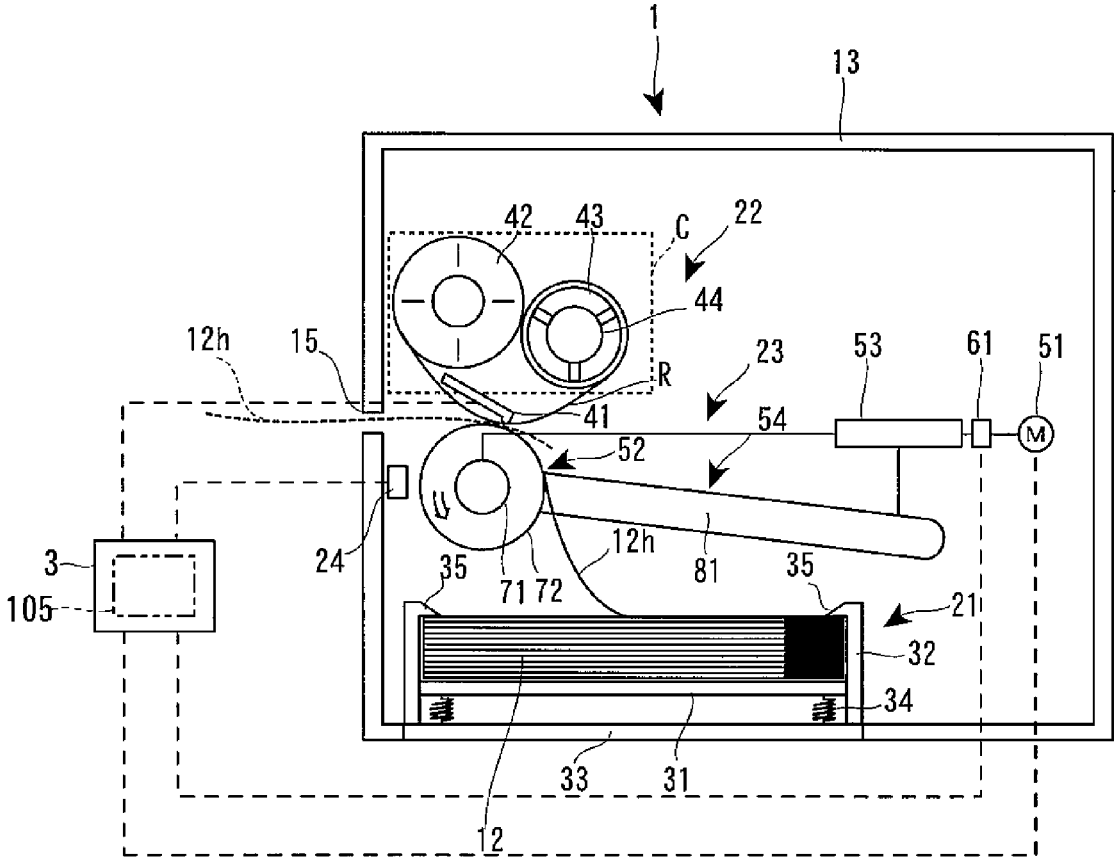
FIG. 3 is a schematic diagram partly shown in section of the sticky note printer.

As shown in FIG. 3, the inside construction of the printer casing 13 is made up of: a sticky note holder 21 which is positioned on the bottom side and faces the sticky note feed opening 14, in a manner to detachably hold in position the bundle of sticky notes; a sticky note printing unit 22 which is positioned above the sticky note holder 21 so as to print on the sticky note 12*h;* a sticky note feeding unit 23 which peels off the sticky note 12*h* one by one off from the bundle of sticky notes 12 and feeds the peeled sticky note in a normal direction (i.e., to the left as seen in FIG. 3) and a reverse (opposite) direction (i.e., to the right in FIG. 3) to and from the sticky note ejecting slot 15; and a sticky note detection sensor 24 which detects the presence or absence of the peeled sticky note 12*h* at a position near the sticky note ejecting slot 15. The feeding of the sticky note in the normal and reverse directions, which is performed by the sticky note feeding unit 23, is made up of: an empty-feed (or free-feed) motion in which the sticky note 12*h* is fed in the normal direction from the peel-off position through the sticky note ejecting slot 15 to a pull-out position in which the peeled sticky note protrudes outside (or beyond) the sticky note printer 2 so as to be pulled out of the sticky note printer 2; a feed-back motion in which the sticky note 12*h* is fed in the reverse direction from the pull-out position to a retracted position in which printing can be performed by the sticky note printing unit; and a feed-again motion in which the sticky note is fed once again in the normal direction from the retracted position to the pull-out position (details will be given hereinafter).

The sticky note holder 21 is made up of: a rectangular setting stage 31 which horizontally sets in position the bundle of sticky notes 12; installation guides 32 which slidably guide the setting stage 31 in a vertical direction; a lid 33 which is arranged to be fixed to the bottom of the installation guides 32 for closing, in this state, the sticky note feed opening 14; and four pressurizing springs 34 which are disposed on four corners of the setting stage 31 between the setting stage 31 and the lid 33. The four pressurizing springs 34 are respectively engaged with the lower surface of the setting stage 31 and the upper surface of the lid 33. By means of these four pressurizing springs 34, the setting stage 31 is urged upwards in a well-balanced manner, with the lid 33 serving as a supporting base.

The installation guides 32 are formed to correspond to the shape of the sticky note 12*h*. The inner surfaces thereof are in communication with the sticky note feed opening 14, thereby guiding the bundle of sticky notes 12 placed on the setting stage 31 while keeping them in position. At the front and rear of the upper opening of the installation guides 32, there are provided in a manner projecting inwards a pair of position regulators 35, 35 which serve to hold the front end (free-end side) and the rear end (glued side) of the bundle of sticky notes 12. In other words, the pair of the position regulators 35, 35 hold the bundle of sticky notes 12 relative to the setting stage 31 and also horizontally hold the uppermost sticky note 12*h* at a predetermined position.

The lid 33 is formed substantially the same in outer shape as the setting stage 31 so as to get fit into the bottom opening of the installation guide 32 and is fixed to the bottom surface of the installation guide 32. The lid 33 closes the sticky note feed opening 14 in this state, and the bottom surface thereof is flush with the bottom surface of the printer casing 13.

As a result of the above-described arrangement, the bundle of sticky notes 12 is urged against the position regulators 35 of the installation guide 32 (i.e., pushed to a setting position) with a uniform force. It is thus so arranged that, even if the bundle of sticky notes 12 is reduced in amount by feeding of the sticky note 12*h* one by one, the sticky note 12*h* lying at the uppermost position can be always maintained at the predetermined position.

The sticky note feeding unit 23 is made up of: a driving motor 51 which serves as a driving source; a pickup roller 52 which rotates to feed the flipped (or turned over) sticky note 12*h* by holding it between a thermal head 41 (to be described in detail hereinafter) and the pickup roller 52; a reduction gear train 53 which transmits the driving force of the driving motor 51 to the pickup roller 52; and a roller rotating unit 54 which rotatably holds the pickup roller 52 at its front end so as to rotate (swing with one end serving as a fulcrum) between a contact position in which the pickup roller 52 comes into rotating contact with the sticky note 12*h* and a feeding position in which the pickup roller 52 comes into contact with the thermal head 41.

The driving motor 51 is a DC motor with commutator, and a pulse disc is fixed to an output shaft thereof. A photo-interrupter is assembled into a position facing the pulse disc so as to constitute an encoder 61 by the pulse disc and the photo-interrupter. Based on pulse signals to be outputted by the encoder 61, control is made of the heating of the thermal head 41 and the amount of feeding by the sticky note feeding unit 23.

The pickup roller 52 is made up of: a roller main body 72 which flips (or turns over) the sticky note 12*h* by coming into rotating contact therewith; a roller shaft 71 having rotatably mounted thereon the roller main body 72; and a roller gear (not shown) which rotates integrally with the roller main body 72. The roller shaft 71 extends in parallel with the thermal head 41, and the roller main body 72 is disposed in a halt portion on one side of the roller shaft 71. The roller gear is adjacent to the roller main body 72 and is integrally formed therewith. The pickup roller 52 is arranged to rotate as a result of transmission of the driving force of the driving motor 51 through the reduction gear train 53.

The surface of the roller main body 72 is constituted by a highly abrasion-resistant material having a heat resistance such as a silicone rubber. The pickup roller 52 has a function of flipping the sticky note 12*h* by coming into rotating contact therewith as well as a function as a platen roller which cooperates with the thermal head 41. Therefore, there is no need of additionally providing a platen roller, thereby reducing the number of constituting parts and the number of assembling steps. In addition, the length of the circumference of the roller main body 72 is arranged to be greater than the length of the sticky note 12*h* as seen in the feeding direction thereof. According to this arrangement, it is possible to rectify the bending tendency of the sticky note 12*h* rolled round the roller by means of the glued portion. Further, since the sticky note 12*h* does not form an overlapped portion, there can be prevented jamming due to slippage at the overlapped portion of the sticky note 12*h*.

The roller rotating unit 54 is made up of: a pair of rotating arms 81, 81 which support the roller shaft 71 at both axial ends of the roller shaft 71 in a rotatable manner and which also rotate about a base end portion thereof 81, 81 (i.e., swing with the base end portion serving as a fulcrum); a planetary gear train (not shown) which utilizes part of the gears constituting the above-described reduction gear train 53; and a cam mechanism (not shown) which transforms the rotation of the gears to the rotating (swinging) motion of the rotating arms 81. Namely, the circular movement of the planetary gear mechanism is transformed into a reciprocating movement of the rotating arms 81 by means of the cam mechanism. As a result of the reciprocating (back-and-forth) rotating movement of the rotating arms 81, the pickup roller 52 rotates (swings) between the rotating-contact position and the feeding position.

The printing unit 22 is made up of: the thermal head 41 which is disposed near the sticky note ejecting slot 15; a ribbon pay out reel 42 which is rotatably contained in the ribbon cartridge C and which has rolled an ink ribbon R thereabout in a manner to be freely paid out; and a ribbon take-up reel 43 which takes up the ink ribbon R. The ribbon pay out reel 42 is arranged to be freely rotatable. The ribbon take up reel 43 is rotated by engaging with a ribbon take up shaft 44. The ink ribbon R paid out of the ribbon pay out reel 42 thus travels for being taken up by the ribbon take up reel 43. The direction of feeding the ink ribbon R is the same as the feed-back direction of the sticky note 12*h* (details will be described hereinafter).

The ink ribbon R is paid out of the ribbon pay out reel 42 and travels in parallel with the sticky note 12*h* in an overlapped positional relationship with each other at the position of the thermal head 41 and is finally taken up by the ribbon take up reel 43. Namely, the sticky note 12*h* and the ink ribbon R are sandwiched between the pickup roller 52 and the thermal head 41, and the printing is performed on the sticky note 12*h* by heating of a thermal element while feeding them in the same direction.

The ribbon take up shaft 44 forms a part of the ribbon take up mechanism which, as a result of upward movement of the pickup roller 52 into the feeding position, transmits the power from the roller gear through a one-way clutch. When the pickup roller 52 rotates in the reverse direction of rotation (i.e., opposite to that of an arrow in the figure), at the feeding position, so as to feed the sticky note 12*h* in the reverse direction toward the inside of the sticky note printer (feed-back motion), the clutch gets engaged with the ribbon take up shaft 44, thereby rotating the ribbon take up reel 43. On the other hand, when the pickup roller 52 rotates in the normal direction of rotation (i.e., in the direction of the arrow shown in the figure) so as to feed the sticky note 12*h* in the normal direction toward the sticky note ejecting slot 15 (empty-feed motion, feed-again motion), the clutch gets out of engagement with the ribbon take up shaft 44, thereby rotating in an idle manner. In other words, the ribbon take up mechanism is arranged to rotate the ribbon take up reel 43 only when the sticky note 12*h* is fed for printing and to cause the ink ribbon R to travel along with the sticky note 12*h*. According to this arrangement, the ink ribbon R can be prevented from being wasted in paying out, and also the ink ribbon R can be prevented from causing an unnecessary slack.

The sticky note sensor 24 is disposed between the pickup roller 52 and the sticky note ejecting slot 15, thereby detecting the presence or absence of the sticky note 12*h*. It is made up of an optical transmittance or reflective sensor in which a light emitting element and a light receiving element are built in so as to lye opposite to each other with the sticky note 12*h* sandwiched therebetween.

Detection signals from the sticky note sensor 24 are outputted to the personal computer 3 and, based on the detection result, a detection is made as to whether or not the sticky note 12*h* has been pulled out of the sticky note ejecting slot 15. Namely, although the user has not given from the personal computer 3 an instruction to start the printing job, when the sticky note 12*h* has been pulled out of the pull-out position and accordingly the sticky note sensor 24 has detected the absence of the sticky note 12*h*, the control unit 105 determines that the sticky note 12*h* has been "pulled out," and controls the sticky note printer 2 so that a new sticky note 12*h* is fed from the sticky note holder 21. At the pull-out position, the sticky note 12*h* is exposed to the outside of the sticky note printer 2 for the most part thereof except for the base end portion thereof.

With reference to FIGS. 4A to 4H, a description will now be made about a series of operations from the flipping (turning over) of the sticky note 12*h* to the ejection thereof out of the sticky note printer 2. When the user sets a bundle of sticky notes 12 to the sticky note holder 21 and switches on the sticky note printer 2 which is connected to the cable 4, the sticky note detection sensor 24 detects the absence of the sticky note 12*h*. Then, the pickup roller 52 moves to the rotating-contact position (i.e., the position in which the pickup roller 52 comes into rotating contact with the sticky note 12*h*), whereby the pickup roller 52 comes into rotating contact with the surface of the uppermost sticky note 12*h* set in position in the sticky note holder 21 (FIG. 4A). The sticky note printer 2 may be supplied with power through the cable 4 (USB cable and the like) from the personal computer 3.

Then, the pickup roller 52 starts rotating and the flipping motion of the sticky note 12*h* is started. In other words, as a result of a motion in which the pickup roller 52 comes into rotating contact with the free-end surface of the uppermost sticky note 12*h*, the intermediate portion as seen in the longitudinal direction of the sticky note 12*h* is gradually distorted or deformed by bending upwards (FIG. 4B).

Right after the front end of the sticky note 12*h* during flipping motion has passed under the pickup roller 52, the pickup roller 52 moves up while rotating, thereby departing from the bundle of sticky notes 12. Here, due to the rotational force of the pickup roller 52, the sticky note 12*h* is bounced or forced into a position above the pickup roller 52, whereby the free-end portion of the sticky note 12*h* gets settled (or is caused to lie) on the pickup roller 52 (FIG. 4C).

The pickup roller 52 having settled thereon the sticky note 12*h* (or the pickup roller 52 having the free end of the sticky note 12*h* in touch with the upper surface of the pickup roller 52) then moves (i.e., makes an orbit motion) while rotating on its own axis of rotation. Once the pickup roller 52 reaches the feeding position, the pickup roller 52 holds the sticky note 12*h* between the thermal head 41 and the pick up roller 52 (FIG. 4D). The pickup roller 52 thus comes into rotating contact with the back surface of the largely inclined sticky note 12*h* from the free end thereof, thereby peeling it off from the bundle of sticky notes 12. In this manner, the pickup roller 52 performs rotation (or rotary) feeding of the sticky note 12*h* toward the sticky note ejecting slot 15 with the free end thereof at the head of the traveling (referred to as an empty-feed motion, i.e., a feed motion without printing job). In this empty-feed motion, feeding is made by predetermined steps based on the output of the encoder. As a result, when the glued portion of the sticky note 12*h* has reached (or adhered to) the pickup roller 52, the rotation of the pickup roller 52 stops. In this state, the sticky note 12*h* keeps on standing-by in the pull-out position. It follows that the user can easily pick up the sticky note 12*h* with fingers for further pulling it out of position(i.e., away from the sticky note printer 2). In addition, since the glued portion is in a state of being slightly adhered to the pickup roller 52, the sticky note 12*h* is prevented from dropping out of position. This state is represented in this invention as "an ordinary state." It is to be noted that the control to stop the empty-feed motion may alternatively be made by using the sticky note detection sensor 24. Namely, once the front end of the sticky note 12*h* has been detected by the sticky note detection sensor 24, feeding is made by predetermined steps and then the empty-feed motion is stopped.

When the user pulls out the sticky note 12*h* from the sticky note ejecting slot 15 in the above-described ordinary state, the sticky note detection sensor 24 detects the "absence" of the sticky note 12*h*. Then, a new sticky note 12*h* is automatically fed from the bundle of sticky notes 12 to the pull-out position by the same motions as those noted above (FIGS. 4A to 4D: empty-feed motion). According to this arrangement, it is possible to obtain print-free (i.e., not printed) sticky notes 12*h* one after another without giving an instruction to empty-feed the sticky notes 12*h*. The sticky note printer 2 can thus be used as a dispenser for supplying sticky notes.

On the other hand, when the user gives an instruction to start printing based on the data inputted from the personal computer 3 without pulling out the sticky note 12*h* out of the sticky note ejecting slot 15 (in a state in which the sticky note sensor 24 has detected the "presence" of the sticky note 12*h*), the pickup roller 52 rotates in the reverse direction so as to pull the sticky note 12*h* back into the sticky note printer (feed-back motion). Feeding (paying out) of the ink ribbon R is started at the same time (FIG. 4E).

In cooperation with the thermal head 41, the pickup roller 52 then performs printing on the surface of the sticky note 12*h* from the side of the glued portion (FIG. 4F: feed-back motion). During the feed-back motion in this printing motion, the glued portion of the sticky note 12*h* is slightly adhered to the surface of the pickup roller 52 and, therefore, the sticky note 12*h* is fed back in a manner to be wound around the periphery of the pickup roller 52. This feed-back motion accompanied by printing job is also controlled by the encoder output such that the rotation of the pickup roller 52 stops immediately upon contact of a free margin on the free-end side of the sticky note 12*h* with the pickup roller 52 (stopped position is referred to as "a retracted position"). It is so arranged that, when the user gives an instruction to start the printing job, a new sticky note 12*h* is not fed from the bundle of sticky notes 12, even if the sticky note detection sensor 24 detects the "absence" of the sticky note 12*h*.

When the printing job has been finished, the pickup roller 52 rotates for feeding again the sticky note 12*h* from the retracted position to the sticky note ejecting slot 15 with the free end leading the traveling direction (FIG. 4G: feed-again motion). This feed-again motion is also controlled by the encoder output such that the printed sticky note 12*h* is fed in the normal direction up to the pull-out position. Needless to say, in the empty-feed motion and the feed-again motion, the sticky note 12*h* is fed with the free end leading the traveling direction. According to this arrangement, jamming at the sticky note ejecting slot 15 can be prevented, thereby facilitating the pulling out of the sticky note 12*h* by the user.

When the user gives an instruction for the next printing job after the sticky note 12*h* has been pulled out by the user, the pickup roller 52 starts rotation again and departs from the thermal head 41, thereby returning to the rotating-contact position (FIG. 4H).

In this embodiment, the feeding for printing (print-feeding) is performed while the sticky note 12*h* is being pulled into the sticky note printer 2 from the ordinary state. Alternatively, it may also be so arranged that the sticky note 12*h* is empty-fed into the sticky note printer 2 from the ordinary state so as to print-feed the sticky note 12*h* from the retracted position toward the sticky note ejecting slot 15. In this case, the ribbon pay out reel 42 and the ribbon take up reel 43 shown in FIG. 3 are disposed oppositely as seen in the left and right direction and, instead of an arrangement in which the driving force of the driving motor 51 is transmitted from the pick up roller 52, a motor is provided for exclusive use in paying out the ink ribbon R. Print-feeding is thus performed by moving the driving motor 51 and the exclusive-use motor in a manner synchronized with each other.

As described hereinabove, according to the sticky note printer 2 of this embodiment, the sticky note 12*h* can be held in a standby state ready for being pulled out. By defining this state as an ordinary state, the ease with which the user can use the sticky note printer is improved. In addition, it is preferable that the sticky note 12*h* be kept to the feed-back state at the time of switching off of the sticky note printer 2. Regardless of the switching on or switching off of the sticky note printer 2, it may also be so arranged that the sticky note 12*h* is always kept protruded out of the sticky note ejecting slot 15.

What is claimed is:

1. A sticky note printer comprising:

a printing device for printing on a sticky note which is peeled off and fed one by one from a bundle of sticky notes set in position;

a feeding device for performing: an empty-feed motion in which the sticky note is fed in a normal direction from a peel-off position through a sticky note ejecting slot to a pull-out position in which the sticky note protrudes outside the sticky note printer; a feed-back motion in which the sticky note is fed in a reverse direction from the pull-out position to a retracted position in which printing can be performed by the printing device; and a feed-again motion in which the sticky note is fed in the normal direction from the retracted position to the pull-out position;

an instructing device for giving an instruction for printing on the sticky note;

a detecting device for detecting presence or absence of the sticky note in the pull-out position; and a control device for controlling the printing device and the feeding device, wherein the control device performs in a state in which the sticky note is fed to the pull-out position: the empty-feed motion upon detection of absence of the sticky note by the detecting device on condition of no instruction from the printing device; the feed-back motion and the feed-again motion upon receipt of the instruction from the printing device on condition of detection of presence of the sticky note by the detecting device; and a printing motion by driving the printing device in a manner synchronized with one of the feed-back motion and the feed-again motion.

2. The sticky note printer according to claim 1, wherein the state in which the sticky note has been fed to the pull-out position is an ordinary state at least under a condition in which the sticky note printer is powered on.

3. The sticky note printer according to claim 1, wherein the feeding device feeds the sticky note with a free end thereof at a head of moving direction in the empty-feed motion and the feed-again motion.

4. The sticky note printer according to claim 1, wherein the feeding device comprises a roller for feeding the sticky note in the normal direction and in the reverse direction by coming into rotating contact with that side of the sticky note which has a glued portion, and wherein a circumferential length of the roller is greater than the length of the sticky note as seen in the feeding direction thereof.

5. The sticky note printer according to claim 4, wherein the roller is disposed near the sticky note ejecting slot, and wherein, in the pull-out position, the glued portion of the sticky note is in contact with the roller.

6. The sticky note printer according to claim 4, wherein the printing device comprises a thermal head, and wherein the roller serves a dual purpose of a platen which lies opposite to the thermal head.

7. The sticky note printer according to claim 1, wherein the printing device comprises a ribbon feeding mechanism for feeding an ink ribbon along with the sticky note in a manner synchronized with driving of the printing device only at the time of driving the printing device.

8. A method of controlling a sticky note printer, the sticky note printer comprising:

a printing device for printing on a sticky note which is peeled off and fed one by one from a bundle of sticky notes set in position;

a feeding device for performing: an empty-feed motion in which the sticky note is fed in a normal direction from a peel-off position through a sticky note ejecting slot to a pull-out position in which the sticky note protrudes outside the sticky note printer; a feed-back motion in which the sticky note is fed in a reverse direction from the pull-out position to a retracted position in which printing can be performed by the printing device; and a feed-again motion in which the sticky note is fed in the normal direction from the retracted position to the pull-out position; the method comprising:

performing the empty-feed motion when the sticky note is pulled out of position from a state in which the sticky note is fed to the pull-out position;

performing the feed-back motion and feed-again motion when an instruction for printing is given; and performing a printing motion by driving the printing device in a manner synchronized with one of the feed-back motion and the feed-again motion.

* * * * *